US009327327B2

(12) United States Patent
Shinmiya et al.

(10) Patent No.: US 9,327,327 B2
(45) Date of Patent: May 3, 2016

(54) METHOD OF MANUFACTURING PIPE WITH DIFFERENT DIAMETER ALONG A LONGITUDINAL DIRECTION AND DIE FOR FORMING

(71) Applicant: JFE Steel Corporation, Tokyo (JP)
(72) Inventors: Toyohisa Shinmiya, Fukuyama (JP); Kazuhiko Higai, Chiba (JP); Yuji Yamasaki, Fukuyama (JP); Katsuhiro Ochi, Fukuyama (JP)
(73) Assignee: JFE Steel Corporation (JP)

( * ) Notice: Subject to any disclaimer, the term of this patent is extended or adjusted under 35 U.S.C. 154(b) by 0 days.

(21) Appl. No.: 14/403,674
(22) PCT Filed: May 24, 2013

(86) PCT No.: PCT/JP2013/003309
§ 371 (c)(1),
(2) Date: Nov. 25, 2014

(87) PCT Pub. No.: WO2013/179628
PCT Pub. Date: Dec. 5, 2013

(65) Prior Publication Data
US 2015/0165503 A1 Jun. 18, 2015

(30) Foreign Application Priority Data
May 29, 2012 (JP) ..... 2012-121474
Apr. 10, 2013 (JP) ..... 2013-082046

(51) Int. Cl.
*B21D 22/26* (2006.01)
*B21C 37/16* (2006.01)
(Continued)

(52) U.S. Cl.
CPC ..... *B21C 37/16* (2013.01); *B21C 37/0815* (2013.01); *B21D 5/015* (2013.01); *B21D 37/16* (2013.01); *B21C 37/185* (2013.01)

(58) Field of Classification Search
CPC .... B21D 5/015; B21D 37/16; B21C 37/0815; B21C 37/185; B21C 37/16
See application file for complete search history.

(56) References Cited

U.S. PATENT DOCUMENTS 1,879,077 A * 9/1932 Carlsen ..... B21C 37/0822 72/347
1,879,078 A * 9/1932 Carlsen ..... B21C 37/0822 72/347
(Continued)

FOREIGN PATENT DOCUMENTS

JP 3-291115 12/1991
JP 5-123741 5/1993
JP 4713471 4/2011

OTHER PUBLICATIONS

Supplementary European Search Report dated May 22, 2015 of corresponding European Application No. 13798156.9.
(Continued)

*Primary Examiner* — David B Jones
(74) *Attorney, Agent, or Firm* — DLA Piper LLP (US)

(57) ABSTRACT

A method of manufacturing a pipe with different diameters along a longitudinal direction that has a small diameter portion, a large diameter portion, and a diameter-changing portion provided between the small diameter portion and the large diameter portion and is formed by press forming a blank made of a metal sheet includes press forming the blank with a U-shape forming die into a U-shaped formed part and press forming the U-shaped formed part with an O-shape forming die set into a circular cross-section formed part. A length of a vertical wall of the U-shape forming die is longer than a length of a vertical wall portion of the U-shaped formed part. In the O-shape forming die set, a die mating line is inclined downwardly, and a ratio t/D of a sheet thickness t of the blank to a diameter D, which represents a diameter of a portion of the O-shape forming die set corresponding to the small diameter portion and a diameter of a portion of the O-shape forming die set corresponding to the large diameter portion, is $0.010 \leq t/D \leq 0.080$.

5 Claims, 6 Drawing Sheets

(51) Int. Cl.

| | |
|---|---|
| ***B21D 5/01*** | (2006.01) |
| ***B21C 37/08*** | (2006.01) |
| ***B21D 37/16*** | (2006.01) |
| *B21C 37/18* | (2006.01) |

(56) References Cited

U.S. PATENT DOCUMENTS 2,077,336 A * 4/1937 Lemming ..... B21D 5/015 72/398
4,148,426 A * 4/1979 Midzutani ..... B21D 5/015 228/146
5,924,316 A * 7/1999 Streubel ..... B21C 37/065 72/367.1
7,350,386 B2 * 4/2008 Streubel ..... B21C 37/0815 219/61
7,418,849 B2 * 9/2008 Hauger ..... B21C 37/185 72/367.1
7,637,135 B2 * 12/2009 Homig ..... B21C 37/065 72/367.1
2005/0126241 A1 * 6/2005 Ooyauchi ..... B21C 37/06 72/51
2007/0131015 A1 * 6/2007 Matsumura ..... B21C 37/108 72/368

OTHER PUBLICATIONS

Korean Office Action dated Jan. 18, 2016 of corresponding Korean Application No. 2014-7034519 along with a Concise Statement of Relevance of Office Action in English.

* cited by examiner

METHOD OF MANUFACTURING PIPE WITH DIFFERENT DIAMETER ALONG A LONGITUDINAL DIRECTION AND DIE FOR FORMING

TECHNICAL FIELD

This disclosure relates to a method of manufacturing a pipe with different diameters along a longitudinal direction and, in particular, relates to a manufacturing method using press forming and to a press forming die for the pipe with different diameters along a longitudinal direction (refers to a pipe having a portion where the pipe diameter varies in the pipe axis direction), which has high dimensional accuracy and is manufactured at high productivity by press forming a blank made of a metal sheet (for example, a high-strength steel sheet having a tensile strength (TS) of equal to or more than 300 Mpa).

The blank refers to a material for forming, which is a single flat sheet cut from an original sheet and has a shape corresponding to the shape of the pipe having undergone the forming.

BACKGROUND

Pipes (having a circular section) having good rigidity and good collision strength are used for some automative parts. Also, many parts having a varying diameter are used from the viewpoint of joining to other parts. As a manufacturing process to obtain pipes with different diameters along a longitudinal direction, there are methods in which metal pipes manufactured by a process such as a UOE process or roll forming are subjected to secondary processing for pipes such as reducing, flaring, or hydroforming (these methods are referred to as "related art I"). There also is related-art regarding a method of manufacturing the pipe with different diameters along a longitudinal direction formed by press forming. According to this known forming method (see Japanese Patent No. 4713471; referred to as "related art II"), to suppress defects such as wrinkling and reduction of the sheet thickness after forming, the shape of the blank is improved and O-shape forming is performed after a U-shape forming has been performed.

With the related art I, pipes having been formed are subjected to secondary processing such as reducing, flaring, or tube forming. Thus, dedicated processing apparatuses are required. This may reduce productivity and lead to an increase in the cost. Furthermore, reducing and flaring are performed on limited positions in many cases, that is, mainly on positions near ends of pipes. Thus, there is a problem with versatility in these methods. With tube hydroforming, the sectional shape can be arbitrarily changed in the longitudinal direction. However, the sheet thickness of a protruding portion is significantly reduced. Thus, it is difficult to obtain a component having a uniform thickness. In addition, since the time required to form is long, there is a problem with productivity.

In the related art II, vertical wall portions of a U-shaped formed part are inserted into an upper die during O-shape forming. This requires a core referred to as a guide blade. A step in which end portions of the blank are bent inwardly is also required before U-shape forming is performed. Furthermore, in the related art I, accuracy in sectional dimensions in a formed product is not described. Accuracy in sectional dimensions is important when a formed product is used as an automative part from the viewpoint of the performance of the part such as rigidity and for assembly. That is, there are problems with the manufacturing cost and the accuracy in product dimensions in the related art II.

That is, with the related art, there is a problem in that a pipe with different diameters along a longitudinal direction, which is manufactured at high productivity and a low cost and with good accuracy in product dimensions, cannot be provided.

SUMMARY

We found that in a pipe having a small diameter portion, a large diameter portion, and a diameter-changing portion provided therebetween, by setting the ratios of the sheet thickness of the material to the diameter of a forming die set corresponding to the small diameter portion and to the diameter of the forming die set corresponding to the large diameter portion in an adequate range, local variation in sheet thickness and wrinkling occurring in a part having been formed can be prevented. Furthermore, by introducing compressive strain in the circumferential direction during forming, the circularity of the part can be improved. Furthermore, after the U-shape forming has been performed, in a die set used for manufacturing in a forming step of circular cross section, wrinkling can be suppressed by increasing a vertical wall length of the U-shape forming die, and forming can be performed without an additional step or a core by using a circular cross section forming die set with die mating lines downwardly inclined.

We thus provide:

(1) A method of manufacturing a pipe with different diameters along a longitudinal direction that has a small diameter portion, a large diameter portion, and a diameter-changing portion provided between the small diameter portion and the large diameter portion and is formed by press forming a blank made of a metal sheet. The method includes a step of press forming the blank with a U-shape forming die into a U-shaped formed part and press forming the U-shaped formed part with an O-shape forming die set into a circular cross section formed part. A length of a vertical wall of the U-shape forming die is longer than a length of a vertical wall portion of the U-shaped formed part. In the O-shape forming die set, a die mating line is inclined downwardly, a ratio t/D of a sheet thickness t of the blank to a diameter D, which represents a diameter of a portion of the O-shape forming die set corresponding to the small diameter portion and a diameter of a portion of the O-shape forming die set corresponding to the large diameter portion, is $0.010 \leq t/D \leq 0.080$, and a circumferential compressive strain given by the following expression (1) is equal to or more than 0.5%.

$$\text{Circumferential compressive strain} = (\text{blank width in sheet width direction that becomes pipe circumferential direction} - \text{perimeter of die set})/\text{perimeter of die set} \times 100(\%) \quad (1).$$

(2) The method of manufacturing the pipe with different diameters along a longitudinal direction according to (1) described above, in which, in the U-shape forming, a bent shape is provided between the large diameter portion and the diameter-changing portion.

(3) The method of manufacturing the pipe with different diameters along a longitudinal direction according to (1) or (2) described above, in which a slot is provided at a top of an arc portion of an upper die of the O-shape forming die set, and a ratio W/t of a slot width W of the slot to the sheet thickness t of the blank is from 2.0 to 3.0.

(4) A forming die sets, which is used in the method of manufacturing according to any one of (1) to (3) described above, includes the U-shape forming die to be initially used and the O-shape forming die set to be used after the U-shape forming die has been used.

A pipe with different diameters along a longitudinal direction having a high circularity can thus be manufactured in a minimum number of press forming steps.

BRIEF DESCRIPTION OF THE DRAWINGS

FIG. 2(*b*) is a plan view illustrating a blank with notches formed at a boundary between a large diameter portion and a width-changing portion that addresses wrinkling during forming.

REFERENCE SIGNS LIST

1 pipe with different diameters along a longitudinal direction
2 blank
3 U-shaped formed part
4 circular cross section formed part

DETAILED DESCRIPTION

Figure 1:
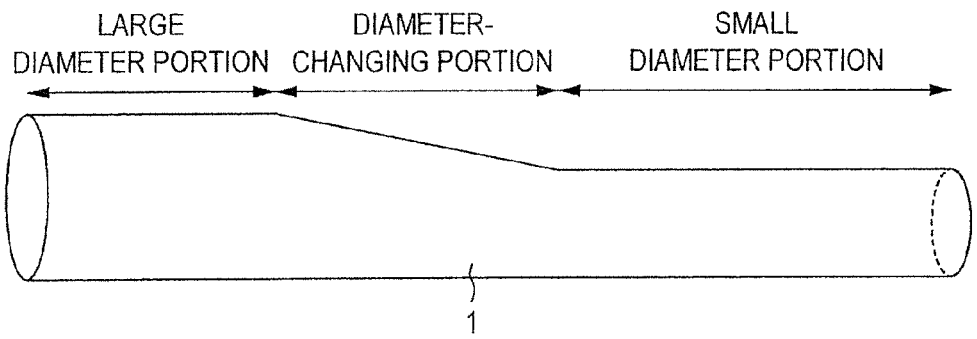
FIG. 1 is a single view drawing illustrating an example of our methods.
Figure 2:
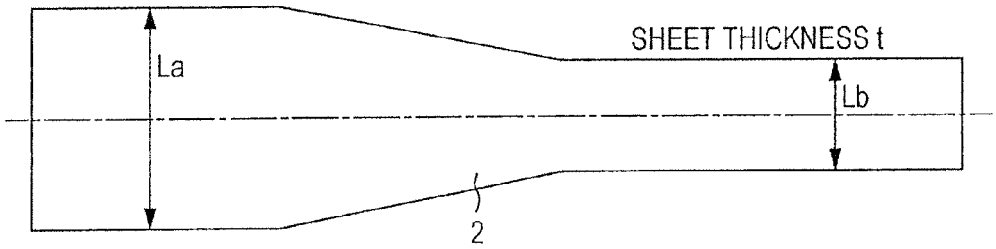
FIG. 2(*a*) is a plan view of a blank corresponding to the example illustrated in FIG. 1.
Figure 2:
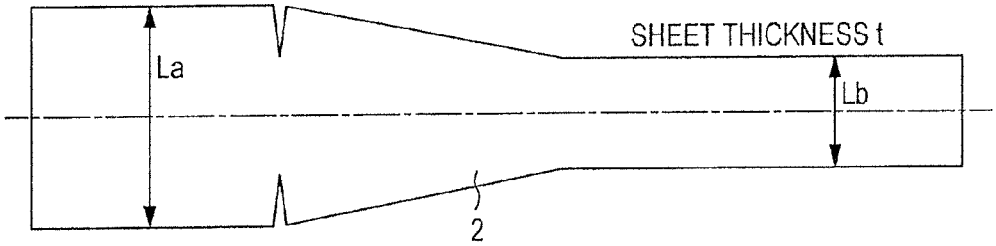

FIG. 1 is a single view drawing illustrating a selected example. FIG. 2(*a*) is a plan view of a blank corresponding to the example in FIG. 1. In FIG. 1 and FIG. 2(*a*), reference sign 1 denotes a pipe with different diameters along a longitudinal direction and reference sign 2 denotes a blank. The blank 2 having a thickness oft is press formed into the pipe with different diameters along a longitudinal direction 1. The pipe with different diameters along a longitudinal direction 1 has a small diameter portion, a large diameter portion, and a diameter-changing portion provided therebetween. The diameter-changing portion has a shape in which the large diameter portion and the small diameter portion are linearly connected to each other. The blank 2 has a planar shape having a large width portion (width La), a small width portion (width Lb), and a width-changing portion connecting the large and small width portions to each other. The large width portion, the small width portion, and the width-changing portion respectively correspond to the large diameter portion, the small diameter portion, and the diameter-changing portion. FIG. 2(*a*) is a plan view illustrating a blank with notches formed at a boundary between the large diameter portion and the width-changing portion as a measure against wrinkling during forming. A blank having this shape may be used.

Figure 3:
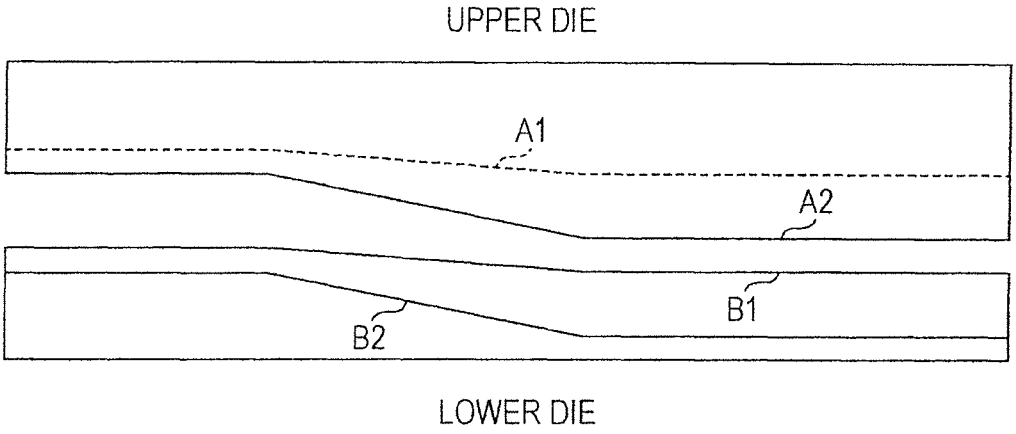
FIG. 3 is a side view illustrating an example of an O-shape forming die set.

FIG. 3 is a side view illustrating an example of an O-shape forming die set. The die set corresponds to the pipe with different diameters along a longitudinal direction illustrated in FIG. 1. In FIG. 3, a region between A1 and A2 and a region between B1 and B2 represent die mating surfaces. A1 and A2 respectively correspond to B1 and B2 at a bottom dead point of the die set.

Regarding the shape of the pipe with different diameters along a longitudinal direction 1, to reduce wrinkling and reliably obtain a good circularity, it is important to control the following i) and ii) to appropriate values:

i) the ratios (t/D) of the blank thickness (t) to the diameter (D), which represents diameters of portions of the die set corresponding to the small diameter portion and the large diameter portion (D represents Db for the diameter of the small diameter portion and Da for the diameter of the large diameter portion), and ii) compressive strain in the circumferential direction.

Circularity is a parameter indicating the deviation from a target diameter and is calculated as follows. That is, the outer diameter of the pipe with different diameters along a longitudinal direction is measured at least eight angularly equally spaced positions, and the circularity is calculated with the following expression: (maximum outer diameter−minimum outer diameter)/diameter of die set×100(%). The compressive strain in the circumferential direction is a value calculated with the aforementioned expression (1).

The ratio (t/D) is a parameter that affects the circularity and buckling during forming.

When t/D is excessively small, that is, the sheet thickness is excessively small or the diameter is excessively large, buckling tends to occur in a circular cross section forming step, which will be described later and, furthermore, sufficient compressive strain in the circumferential direction cannot be applied, thereby the circularity is degraded. To address this, t/D is specified to be equal to or more than 0.010. When t/D is excessively large, that is, the sheet thickness is excessively large or the diameter is excessively small, the blank fails to sufficiently conform to the shape of the die set during circular cross section forming, thereby the circularity is degraded. To address this, t/D is specified to be equal to or less than 0.080. Both the above-described Db and Da is represented by D.

From the viewpoint of reduction of wrinkling in forming near butting portion between the large diameter portion and the diameter-changing portion, an angle θ (inclination angle) formed between portions of the die set corresponding to the large diameter portion and the diameter-changing portion is preferably equal to or smaller than 30 degrees.

Compressive strain in a pipe circumferential direction is an important parameter in reducing the distance between edges of the butting portions and reliably obtaining the circularity in the cross section of a formed product. With the compressive strain in the pipe circumferential direction applied, the blank is brought into tight contact with the dies at a last stage of the circular cross section forming step. This improves circularity. Furthermore, since the circular cross section is formed by compressive bending, springback deformation after removal from the dies is reduced and the distance between edges of the butting portions is reduced. Since the butting portions are joined to each other by, for example, welding after forming, as the distance between edges is reduced, accuracy in butting during joining is improved, and accordingly, the joining work is facilitated. The compressive strain in the pipe circumferential direction is specified to be equal to or more than 0.5% to obtain the circularity of 2.0% or less. When the compressive strain in the pipe circumferential direction is large, there may be biting of the material on the die mating surfaces or an increase in a forming load. For this reason, the compressive strain in the pipe circumferential direction is preferably equal to or less than 5%. When the sheet thickness is small and the diameter is large, increasing the compressive strain leads to buckling. Thus, when the t/D is equal to or less than 0.020, the compressive strain is preferably equal to or less than 2.0%.

The pipe with different diameters along a longitudinal direction is manufactured by, for example, as illustrated in FIGS. 4 to 7, press forming including the following two steps: a step in which the blank 2 is formed into a U-shape to obtain a U-shaped formed part 3; and a step in which circular cross section forming is performed on the obtained U-shaped formed part 3 to obtain the circular cross section formed part 4.

Figure 4:
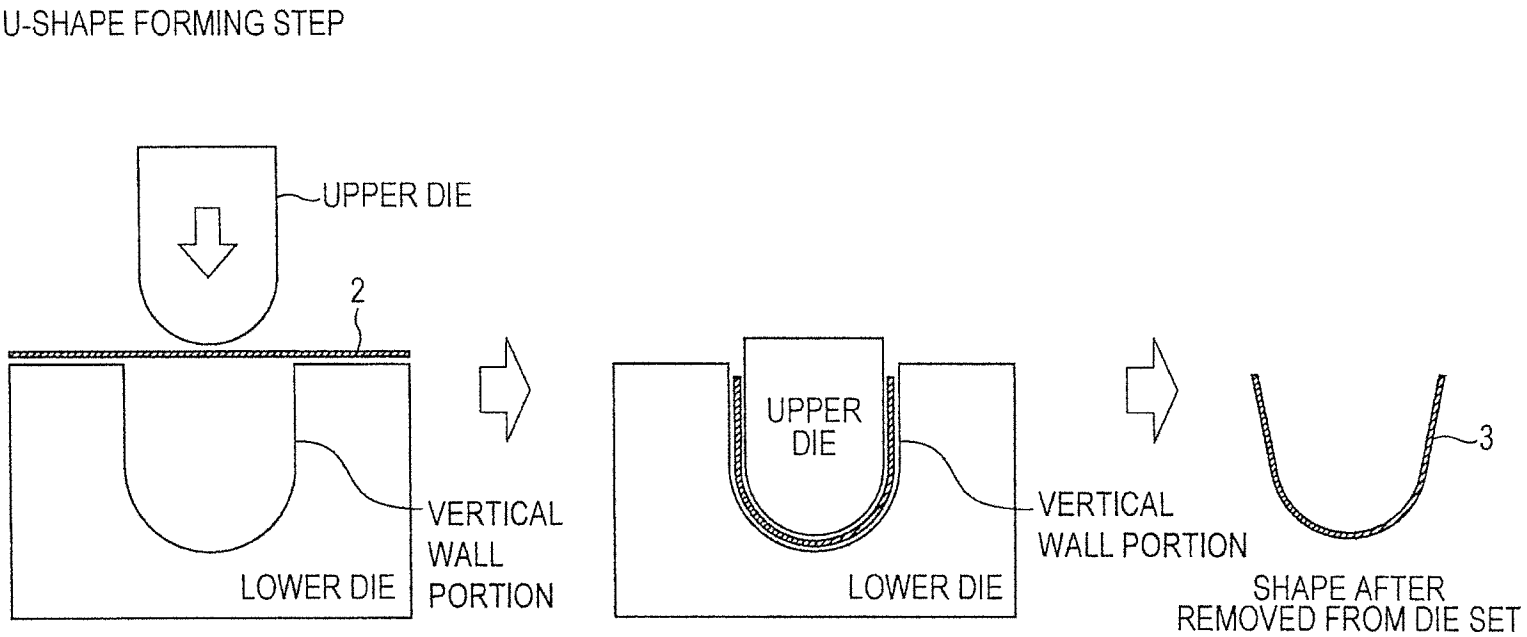
FIG. 4 includes sectional views illustrating an example of a U-shape forming step.

A U-shaped forming illustrated in FIG. 4 is a forming. It is important in designing that a vertical wall length of a lower die of the U-shape forming die set used for the forming is longer than a target vertical wall portion length of the U-shaped formed part 3. Wrinkling tends to occur at a portion between the large diameter portion and the diameter-changing portion during U-shape forming, and performing circular cross section forming on the blank, in which wrinkling occurs, may cause various forming defects or damage to the dies. The wrinkling during the U-shape forming can be reduced by increasing the vertical wall length of the die and performing ironing on portions of the blank 2 corresponding to the vertical walls of the U-shaped formed part during the U-shape forming. The sectional shape of the U-shaped formed part 3 after removal from the dies is a U-shape that is opened due to springback deformation.

Figure 5:
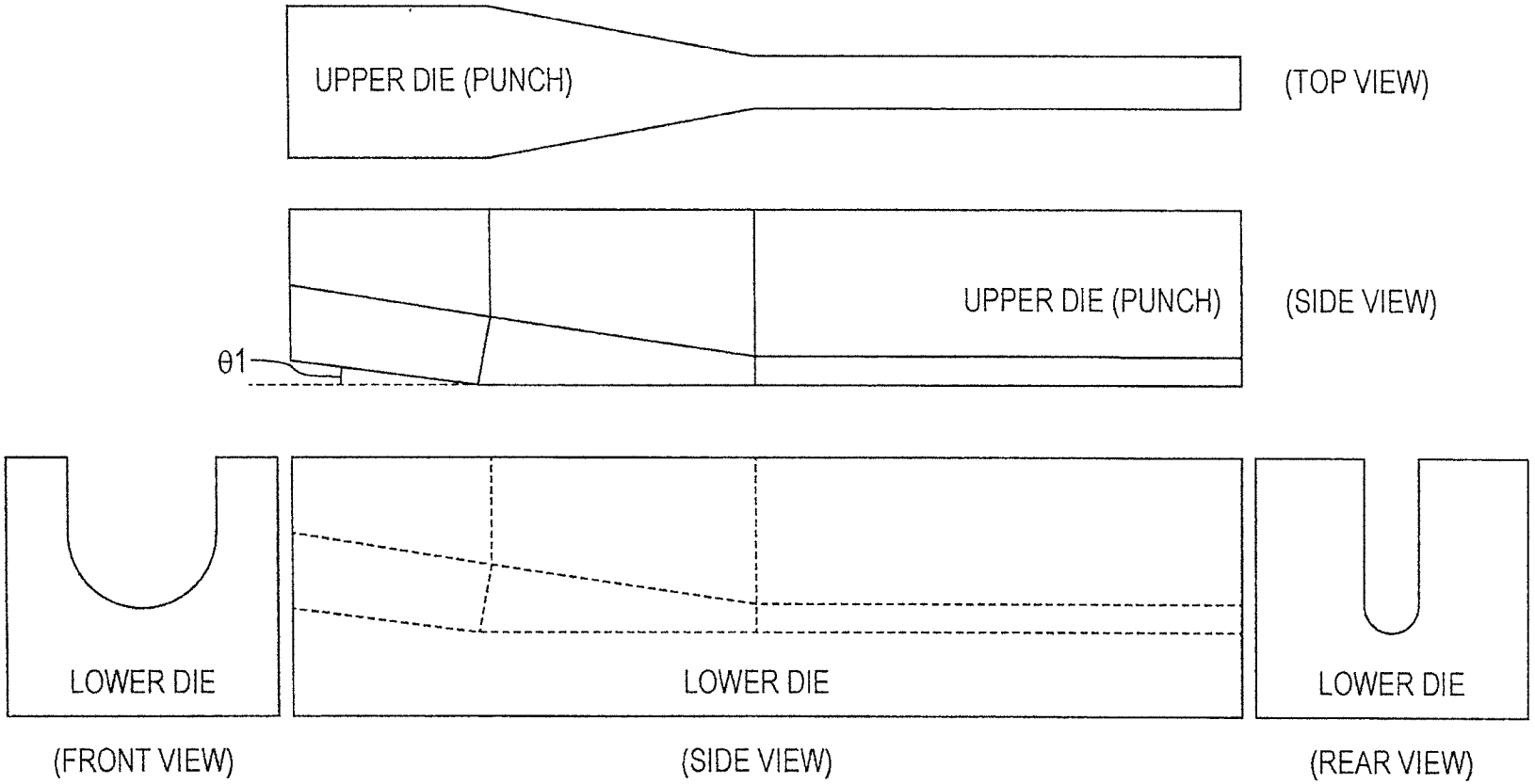
FIG. 5 includes schematic views illustrating an example of a U-shape forming die.

Furthermore, as can be seen in an example of the U-shape forming die set illustrated in FIG. 5, in U-shape forming, by providing a bent shape between the large diameter portion and the diameter-changing portion, wrinkles between the large diameter portion and the diameter-changing portion, the wrinkles tending to be formed in the next O-shape forming step can be further reduced. An increase in a bending angle θ1 during U-shape forming is effective to suppress wrinkling as an angle θ formed between the large diameter portion and the diameter-changing portion of a component is increased. However, when the θ1 is excessively large, wrinkling occurs in the vertical wall portions during the U-shape forming. This makes the O-shape forming difficult to perform. Thus, θ1 is preferably equal to or smaller than 10 degrees.

Figure 6:
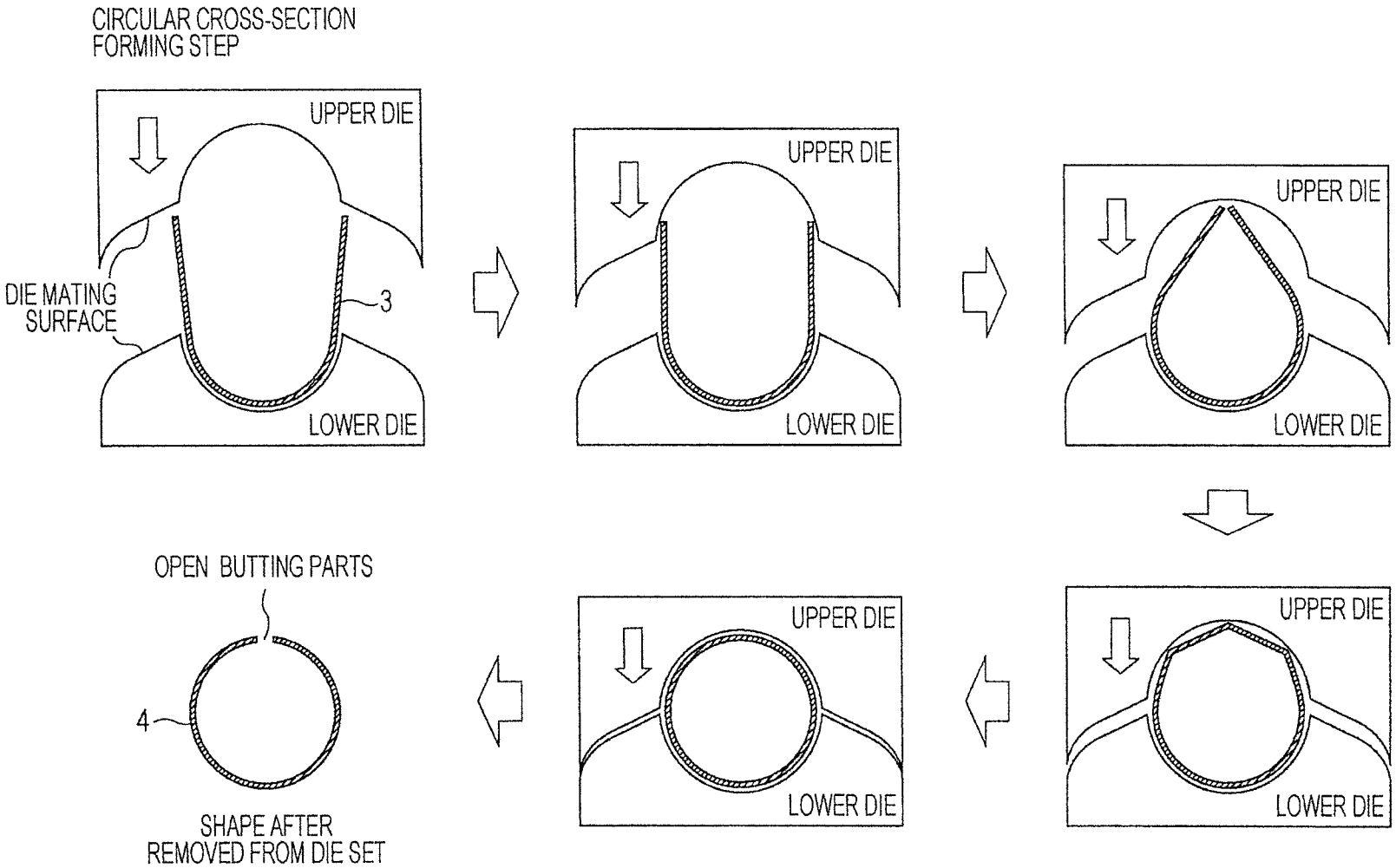
FIG. 6 includes sectional views illustrating an example of a circular cross section forming step.
Figure 7:
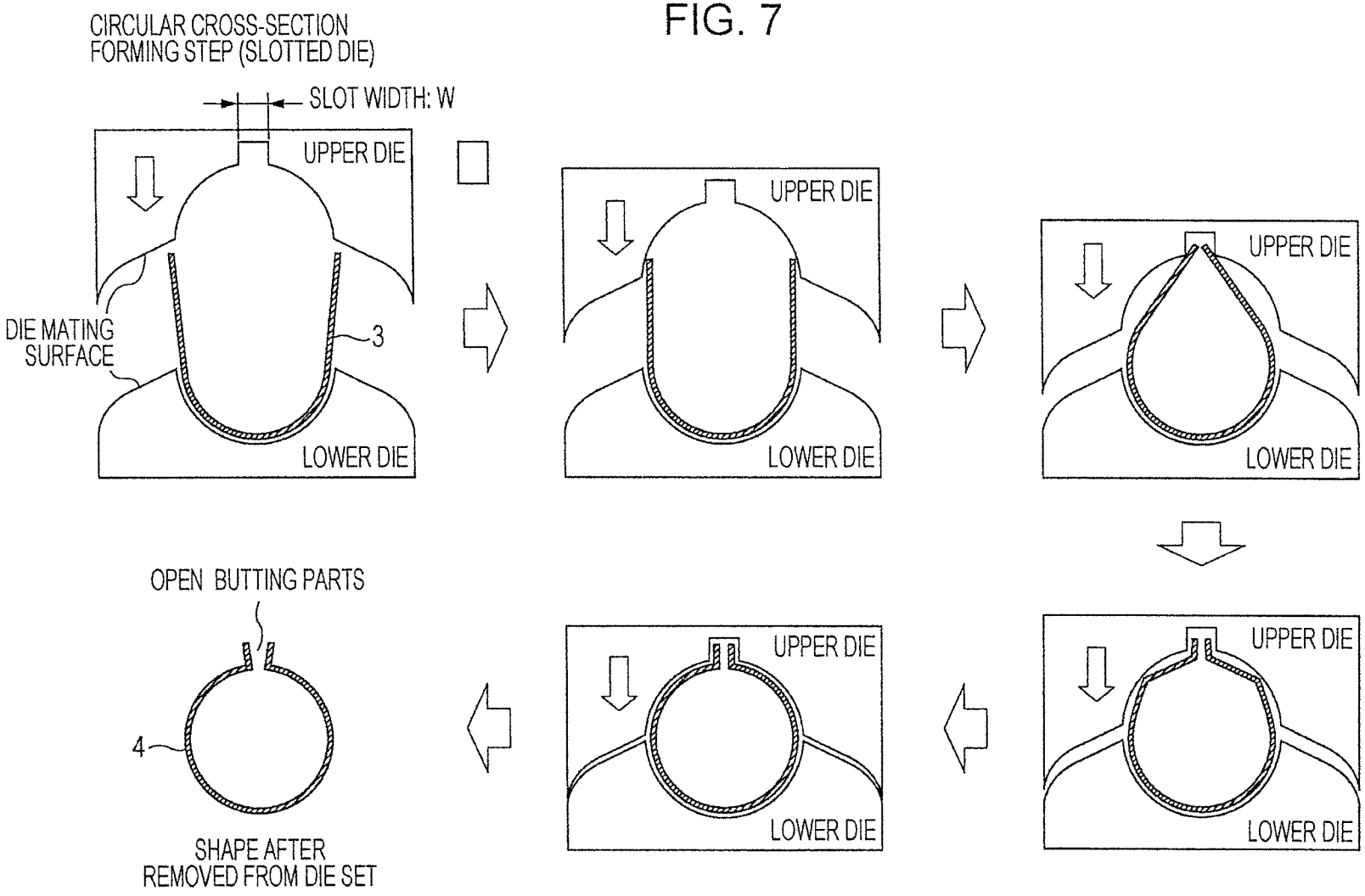
FIG. 7 includes sectional views illustrating an example of a circular cross section forming step (using a slotted upper die).

In a circular cross section forming die set illustrated in FIG. 6, upper and lower dies have semi-circular shapes, and the die mating surfaces are not horizontal but inclined downwardly. The circular cross section forming step is performed as follows. Initially, the U-shaped formed part 3 is set in the lower die, and the upper die is moved down. In so doing, since the U-shaped formed part 3 has an open U-shaped section as described above, the edges of the vertical wall portions of the U-shaped formed part 3 are brought into contact with the mating surfaces in the up-down direction. However, since the die mating surfaces are inclined downwardly, the edges of the vertical wall portions slide against the die mating surfaces. Thus, forming can be advanced without opening of the vertical wall portions. The die mating surfaces may have a linear shape. However, as illustrated in FIGS. 6 and 7, by changing the angle at end portions of the mating surfaces to form a curved shape, the edges of the vertical wall portions can be moved with increased smoothness. After that, the edges of the left and right vertical wall portions are brought into contact with each other, and the U-shaped formed part 3 is deformed while being bent to conform to the shape of the dies and formed to have a circular cross section. After the circular cross section formed part 4 has been removed from the dies, there is a distance between the edges of the butting portions due to sprinback deformation. When the compressive strain in the circumferential direction is small, the U-shaped formed part 3 does not sufficiently conform to the shape of the dies, and the circularity is reduced because bending lines remain. Furthermore, since the sprinback deformation is increased, the distance between edges at the butting portions is increased. The butting portions are joined to each other after the circular cross section formed part 4 has been removed from the dies, thereby a final product is obtained.

As mentioned before, in the above-described manufacturing method, the butting portions need to be joined. Examples of a joining method include welding such as laser welding, arc welding, and spot welding. At this time, when the blank is a thin material, joining is difficult in some cases due to problems such as burn-through. With flanges, joining is easily performed. As illustrated in FIG. 7, with a slot formed at the top of an arc portion of the upper die, the edges of the left and right vertical walls are brought into contact with each other in the slot during forming and, after that, the circular cross section is formed. Thus, the circular cross section formed part with flanges can be formed. However, when the ratio W/t of the slot width W to the sheet thickness t of the blank is less than 2.0, the left and right tips are not contained in the slot and, accordingly, buckling of the circular cross section easily occurs. For this reason, W/t is preferably equal to or more than 2.0. When the W/t is more than 3.0, the flanges are not formed as intended. This may lead to formation of a gap between mating surfaces of the left and right flanges, thereby making the joining difficult. For this reason, W/t is preferably equal to or less than 3.0.

EXAMPLE

The circular cross section formed parts having an entire length of 1400 mm and the shape illustrated in FIG. 1 are formed of blanks made by cutting steel sheets having mechanical characteristics illustrated in Table 1 by press forming in the forms illustrated in FIGS. 4, 6, and 7 performed under various conditions shown in Table 2. After the circular cross section formed parts have been removed from the dies, circumferential butting end portions at a plurality of positions in the pipe axis direction are tack welded to one another in each of the circular cross section formed parts. After that, the shapes of the circular cross section formed parts are evaluated by measuring the circularity and visually determining the presence or absence of forming defects such as wrinkling and buckling. The circularity is obtained as follows: the outer diameter is measured at eight positions spaced apart from one another by 22.5 degrees in the circumferential direction at a position of each of the large diameter portion and the small diameter portion. The circularity is calculated with the following expression and evaluated with a value that is not smaller than the other among the circularities at the large diameter portion and the small diameter portion.

$$\text{Circularity (in \%)} = (\text{maximum outer diameter} - \text{minimum outer diameter})/\text{diameter of die set} \times 100.$$

The results of the evaluation are shown in Table 2. Nos. 1, 2, 4, 6, and 7 to 10, which are our examples, are formed in the step illustrated in FIG. 4 and then in the step illustrated in FIG. 6. Nos. 11 to 13 are examples formed in the step illustrated in FIG. 4 and then in the step illustrated in FIG. 7. The inclination angle formed between the large diameter portion and the small diameter portion can be calculated from the length of the diameter-changing portion and the diameters of the die set corresponding to the large diameter portion and the small diameter portion (4.8 to 9.7 degrees in the present invention examples). Each of the examples exhibits a good circularity without forming defects such as wrinkling and buckling. In contrast, among the comparative examples, the circularity is degraded and buckling occurs in No. 14 because t/Da of it is small. Since No. 15 has large t/Db, it is difficult to obtain the circularity with No. 15 even when the circumferential compressive strain is increased. The circularity is not obtained with No. 16.

TABLE 1

| Material | sheet thickness t (mm) | YP (MPa) | TS (MPa) | El (%) |
|---|---|---|---|---|
| A | 1.8 | 265 | 360 | 40 |
| B | 1.0 | 340 | 460 | 35 |
| C | 1.0 | 400 | 610 | 29 |

TABLE 2

| | | Length (mm) | | | | Die diameter (mm) | | | | | | | | | |
|---|---|---|---|---|---|---|---|---|---|---|---|---|---|---|---|
| | Material | Large diameter portion | Diameter-changing portion | Small diameter portion | Entire length | Large diameter portion Da | Small diameter portion Db | t/Da | t/Db | Circumferential compressive strain (%) | Slot width W/sheet thickness t | U-shape forming die vertical wall length/U-shape formed part vertical wall length | Circularity (%) | Forming defect | Remarks |
| 1 | A | 400 | 400 | 600 | 1400 | 80 | 40 | 0.023 | 0.045 | 1.0 | — | 1.2 | 1.4 | None | Example |
| 2 | A | 200 | 600 | 600 | 1400 | 100 | 40 | 0.018 | 0.045 | 1.0 | — | 1.2 | 1.6 | None | Example |
| 3 | B | 200 | 600 | 600 | 1400 | 100 | 30 | 0.010 | 0.033 | 1.0 | — | 0.8 | 1.7 | Wrinkling | Comparative example |
| 4 | A | 450 | 350 | 600 | 1400 | 100 | 40 | 0.018 | 0.045 | 1.0 | — | 1.2 | 1.7 | None | Example |
| 5 | C | 200 | 600 | 600 | 1400 | 80 | 40 | 0.013 | 0.025 | 1.0 | — | 0.8 | 1.5 | Wrinkling | Comparative example |
| 6 | A | 200 | 600 | 600 | 1400 | 100 | 50 | 0.018 | 0.036 | 0.5 | — | 1.2 | 1.9 | None | Example |
| 7 | A | 200 | 600 | 600 | 1400 | 100 | 50 | 0.018 | 0.036 | 1.5 | — | 1.2 | 0.9 | None | Example |
| 8 | A | 450 | 350 | 600 | 1400 | 100 | 40 | 0.018 | 0.045 | 0.5 | — | 1.2 | 1.7 | None | Example |
| 9 | B | 450 | 350 | 600 | 1400 | 100 | 40 | 0.010 | 0.025 | 0.5 | — | 1.2 | 1.8 | None | Example |
| 10 | C | 450 | 350 | 600 | 1400 | 100 | 40 | 0.010 | 0.025 | 0.5 | — | 1.2 | 1.8 | None | Example |
| 11 | A | 200 | 600 | 600 | 1400 | 100 | 50 | 0.018 | 0.036 | 1.5 | 3.8 | 1.2 | 1.3 | None | Example |
| 12 | B | 200 | 600 | 600 | 1400 | 100 | 50 | 0.010 | 0.020 | 1.5 | 2.2 | 1.2 | 1.0 | None | Example |
| 13 | C | 200 | 600 | 600 | 1400 | 100 | 50 | 0.010 | 0.020 | 1.5 | 2.2 | 1.2 | 1.1 | None | Example |
| 14 | B | 200 | 800 | 400 | 1400 | 150 | 40 | 0.007 | 0.025 | 1.0 | — | 1.2 | 2.1 | Buckling | Comparative example |
| 15 | A | 200 | 800 | 400 | 1400 | 80 | 20 | 0.023 | 0.090 | 5.0 | — | 1.2 | 3.0 | None | Comparative example |
| 16 | B | 200 | 600 | 600 | 1400 | 100 | 50 | 0.010 | 0.020 | 0.0 | — | 1.2 | 3.5 | None | Comparative example |

The invention claimed is:

1. A method of manufacturing a pipe with different diameters along a longitudinal direction that has a small diameter portion, a large diameter portion, and a diameter-changing portion provided between the small diameter portion and the large diameter portion and is formed by press forming a blank made of a metal sheet, comprising:

providing a U-shaped forming die set including a lower die, wherein the lower die includes a forming surface that forms a U-shaped inner cross section having a pair of vertical walls, wherein a length of the vertical walls of the lower die is longer than a length of the vertical walls of a corresponding portion a U-shaped formed part;

press forming the blank with the U-shaped forming die set into the U-shaped formed part having a U-shaped cross section including a pair of vertical walls;

providing an O-shaped forming die set including a lower die in which the U-shaped formed part is set and a upper die to which the vertical walls of the U-shaped formed part contact, wherein each of the lower die and the upper die includes a forming surface having an arc portion that forms a circular inner cross section when the upper die and the lower die are mated at die mating lines and the die mating lines in a cross-sectional view are inclined downwardly from the inner cross section when the lower die is mated under the upper die; and press forming the U-shaped formed part with the O-shape forming die set into a circular cross-section formed part, wherein a ratio t/D of a sheet thickness t of the blank to a diameter D of the circular inner cross section at each of portions of the O-shaped forming die set corresponding to the small diameter portion and the large diameter portion, is $0.010 \leq t/D \leq 0.080$, and a circumferential compressive strain given by expression (1) is equal to or more than 0.5%:

$$\text{circumferential compressive strain} = (\text{blank width in sheet width direction that becomes pipe circumferential direction} - \text{perimeter of die set}) / \text{perimeter of die set} \times 100(\%) \quad (1).$$

2. The method according to claim 1, wherein press forming the blank with the U-shaped forming die set further comprises providing a bent shape between the large diameter portion and the diameter-changing portion such that, in a side view in which the lower die is placed under the U-shaped formed part, the large diameter portion bends upwardly to the diameter-changing portion.

3. The method according to claim 1, further comprising providing a slot at a top of the arc portion of the upper die of the O-shaped forming die set, and a ratio W/t of a slot width W of the slot to the sheet thickness t of the blank is 2.0 to 3.0.

4. The method according to claim 2, further comprising providing a slot at a top of the arc portion of the upper die of the O-shaped forming die set, and a ratio W/t of a slot width W of the slot to the sheet thickness t of the blank is 2.0 to 3.0.

5. Forming die sets used in the method according to claim 1, the forming die sets comprising:

a U-shaped forming die set including a lower die, wherein the lower die includes a forming surface that forms a U-shaped inner cross section having a pair of vertical walls, wherein a length of the vertical walls of the lower die is longer than a length of the vertical walls of a corresponding portion a U-shaped formed part; and an O-shaped forming die set including a lower die in which the U-shaped formed part is set and a upper die to which the vertical walls of the U-shaped formed part contact, wherein each of the lower die and the upper die includes a forming surface having an arc portion that forms a circular inner cross section when the upper die and the lower die are mated at die mating lines and the die mating lines in a cross-sectional view are inclined downwardly from the inner cross section when the lower die is mated under the upper die.

* * * * *